US012584638B2

(12) United States Patent
DeRossett

(10) Patent No.: US 12,584,638 B2
(45) Date of Patent: Mar. 24, 2026

(54) PACKAGED TERMINAL AIR CONDITIONER WITH RECEPTACLE WIRELESS POWER SYSTEM

(71) Applicant: Midea Group Co., Ltd., Beijiao (CN)

(72) Inventor: Andrew Q. DeRossett, Shelbyville, KY (US)

(73) Assignee: MIDEA GROUP CO., LTD., Beijiao (CN)

( * ) Notice: Subject to any disclaimer, the term of this patent is extended or adjusted under 35 U.S.C. 154(b) by 203 days.

(21) Appl. No.: 18/586,176

(22) Filed: Feb. 23, 2024

(65) Prior Publication Data

US 2025/0271151 A1 Aug. 28, 2025

(51) Int. Cl.

| | |
|---|---|
| ***F24F 1/031*** | (2019.01) |
| ***F24F 7/013*** | (2006.01) |
| ***F24F 11/52*** | (2018.01) |
| ***F24F 13/20*** | (2006.01) |

(52) U.S. Cl.

CPC ..... *F24F 1/031* (2019.02); *F24F 7/013* (2013.01); *F24F 11/52* (2018.01); *F24F 13/20* (2013.01); *F24F 2013/207* (2013.01)

(58) Field of Classification Search

CPC ..... F24F 1/031; F24F 1/0057; F24F 1/027; F24F 1/0314; F24F 1/62; F24F 7/013; F24F 2221/17

See application file for complete search history.

(56) References Cited

U.S. PATENT DOCUMENTS

| | | | | |
|---|---|---|---|---|
| 10,446,317 | B2 | 10/2019 | Hall | |
| 10,488,071 | B2 | 11/2019 | Fradkin | |
| 2016/0134127 | A1* | 5/2016 | Yang | H02J 50/10 307/104 |
| 2020/0298167 | A1* | 9/2020 | Jeon | B01D 46/0013 |
| 2020/0408439 | A1* | 12/2020 | Gorman | F24F 13/222 |
| 2021/0369890 | A1* | 12/2021 | Voss | F28G 13/00 |
| 2022/0003447 | A1 | 1/2022 | Williams | |
| 2023/0324053 | A1* | 10/2023 | Fulda | F24F 1/0323 |

FOREIGN PATENT DOCUMENTS

| | | | |
|---|---|---|---|
| CN | 103051070 | A | 4/2013 |
| CN | 211011810 | U | 7/2020 |
| CN | 211739418 | U | 10/2020 |
| CN | 212870140 | U | 4/2021 |
| CN | 114568773 | A | 6/2022 |
| CN | 218096477 | U | 12/2022 |
| CN | 219607327 | U | 8/2023 |

OTHER PUBLICATIONS

IceAir, PTAC Packaged Terminal Air Conditioner Replacement & Retrofit, 20 pages, dated 2013.

* cited by examiner

*Primary Examiner* — Joseph F Trpisovsky
(74) *Attorney, Agent, or Firm* — Gray Ice Higdon

(57) ABSTRACT

A packaged terminal air conditioner with a receptacle wireless power system. The PTAC wireless power system mountable to a wall and includes a wireless power transmitter capable of powering a wirelessly powered PTAC positioned proximate thereto.

21 Claims, 5 Drawing Sheets

PACKAGED TERMINAL AIR CONDITIONER WITH RECEPTACLE WIRELESS POWER SYSTEM

BACKGROUND

The present embodiments relate to a packaged terminal air conditioner and/or receptacle, more specifically a wireless power system for a packaged terminal air conditioner and/or receptacle.

A wide variety of packaged terminal air conditioner(s), hereinafter "PTACs", are commonly used in residential and/or commercial applications. These PTAC heating and/or cooling units are often used in, but not limited to, hotels, motels, and other lodging establishments in the hospitality industry to provide comfortable and consistent temperature control for guests. Many of these PTACs are installed in an opening defined by a sleeve or receptacle that is permanently mounted in an outer wall of a building. A PTAC is often plugged in to a dedicated electrical outlet that is generally hidden from view when the PTAC is in its installed location with the receptacle. The power cords used by such PTACs, however, can be cumbersome and unsightly, both during use and in storage. In addition, PTACs may have different electrical requirements (e.g., 15, 20, or 30 amps and 208, 230, 265, or 277 voltages in the U.S., as well as different types of plugs that are only compatible with certain electrical outlets).

PTACs used in hospitality industry applications may need to be removed, serviced and/or replaced from time to time. However, given that individual PTAC units may have different electrical requirements, and that lodging establishments may install various types of PTACs, receptacles and electrical outlets in different rooms over time, it may be cumbersome for service personnel to swap out PTAC units in a lodging establishment, short of purchasing only PTACs with identical electrical requirements. Thus, there is a need to simplify the management of multiple PTACs within a lodging establishment.

SUMMARY

The herein-described embodiments address these and other problems associated with the art by providing a PTAC receptacle wireless power system, and that includes a wireless power transmitter capable of powering a wirelessly powered PTAC positioned proximate thereto. In some instances, the wireless power transmitter/receiver may be stationary, however the wireless power transmitter/receiver may be movable between storage (e.g. preinstallation) and use positions or configurations relative to a fixed remaining portion of the corresponding PTAC/receptacle.

In some embodiments, a PTAC wireless power system may include a PTAC receptacle. In various embodiments, the PTAC receptacle may be configured to mount to an outer wall. In some embodiments, the PTAC wireless power system may include a wireless power transmitter supported by the PTAC receptacle. In various embodiments, the wireless power transmitter may be configured to generate a wireless power signal to power a wirelessly powered PTAC positioned proximate thereto.

In addition, in some embodiments, the wirelessly powered PTAC may be movable between a deployed position and a stowed position relative to the PTAC receptacle. In various embodiments, the wireless power transmitter may be upwardly-facing to oppose a downwardly-facing wireless power receiver of the wirelessly powered PTAC when the wirelessly powered PTAC is in the stowed position. In some embodiments, the wireless power transmitter may be downwardly-facing to oppose an upwardly-facing wireless power receiver of the wirelessly powered PTAC when the wirelessly powered PTAC is in the stowed position. In various embodiments, the wireless power transmitter may be side-facing to oppose a side-facing wireless power receiver of the wirelessly powered PTAC when the wirelessly powered PTAC is in the stowed position. In some embodiments, the PTAC wireless power system may include a power cord configured to supply power to the wireless power transmitter from a wall-mounted electrical outlet. In various embodiments, the PTAC receptacle may be configured to supply power to the wireless power transmitter from a hard-wired connection of an electrical circuit. In some embodiments, the PTAC wireless power system may include a user interface and a controller configured to operate the user interface and the wireless power transmitter. In various embodiments, a controller may be configured to control a functional operation of the wirelessly powered PTAC using a user interface. In some embodiments, the wirelessly powered PTAC may include a wireless power receiver, a user interface, and a controller configured to operate the user interface and the wireless power receiver. In various embodiments, a controller may be configured to control a functional operation of the PTAC receptacle using a user interface. In some embodiments, the wireless power transmitter may be configured to supply power to a wirelessly powered PTAC including an electric motor and/or a compressor. In various embodiments, the wirelessly powered PTAC may be lacking a power storage element sufficient to otherwise power the wirelessly powered PTAC. In some embodiments, the PTAC receptacle may include one or more members defining at least a portion of a through opening. In various embodiments, the wireless power transmitter may be supported by one or more members of the PTAC receptacle. In some embodiments, the one or more members may include a top wall, a bottom wall, and opposing side walls interconnecting the top wall and the bottom wall. In various embodiments, the PTAC wireless power system may include a controller configured to regulate a power output of the wireless power transmitter. In some embodiments, the controller may be configured to determine the power output required by the wirelessly powered PTAC and control the wireless power transmitter to output a wireless power signal that meets the power output required by the wirelessly powered PTAC. In various embodiments, the wireless power transmitter may be inwardly-facing to oppose an outwardly-facing wireless power receiver of the wirelessly powered PTAC.

In some embodiments, a PTAC wireless power system may include a wirelessly powered PTAC having a wireless power receiver. In various embodiments, the PTAC wireless power system may include a PTAC receptacle having a wireless power transmitter configured to generate a wireless power signal in communication with the wireless power receiver of the wirelessly powered PTAC to power the wirelessly powered PTAC positioned proximate thereto.

In addition, in some embodiments, the PTAC wireless power system may include a user interface and a controller configured to operate the user interface and the wireless power transmitter. In various embodiments, a controller may be configured to control a functional operation of the wirelessly powered PTAC using a user interface. In some embodiments, the wirelessly powered PTAC may include a wireless power receiver, a user interface, and a controller configured to operate the user interface and the wireless power receiver. In various embodiments, a controller may be configured to control a functional operation of the PTAC receptacle using a user interface. In some embodiments, the PTAC wireless power system may include a controller configured to regulate a power output of the wireless power transmitter. In various embodiments, a controller may be configured to determine the power output required by the wirelessly powered PTAC and control the wireless power transmitter to output a wireless power signal that meets the power output required by the wirelessly powered PTAC.

In some embodiments, a wirelessly powered PTAC may include a PTAC unit configured to couple with a PTAC receptacle between a stowed position and a deployed position. In various embodiments, the wirelessly powered PTAC may include a wireless power receiver supported by the wirelessly powered PTAC and configured to receive a wireless power signal provided by a wireless power transmitter of the PTAC receptacle to power the wirelessly powered PTAC when positioned in the stowed position.

Other embodiments may include various methods for making and/or using any of the aforementioned constructions.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
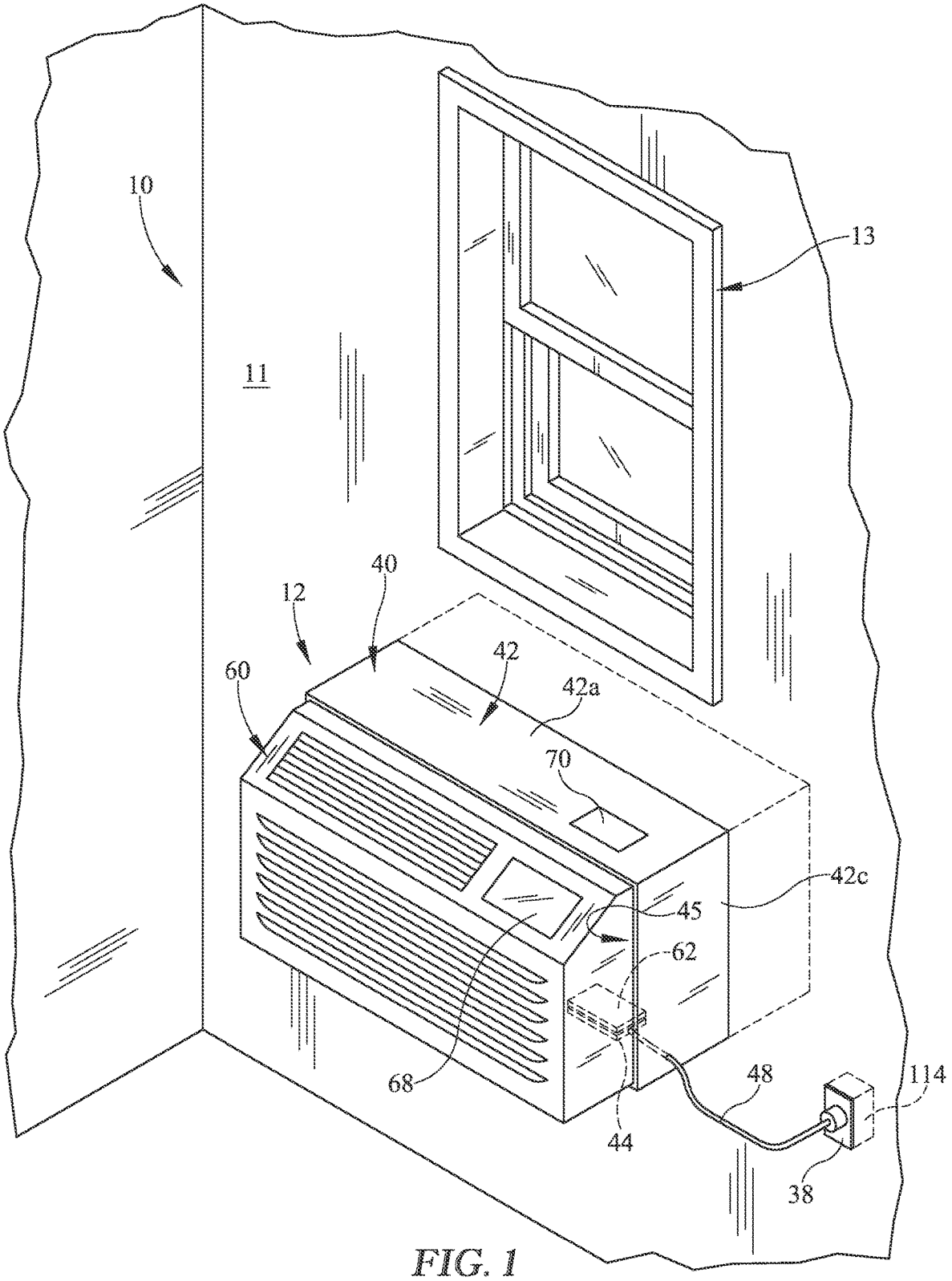
FIG. 1 is a perspective view of a room incorporating a PTAC wireless power system consistent with some embodiments of the invention, illustrating a wirelessly powered PTAC in a stowed position relative to a PTAC receptacle used for providing wireless power.

Turning now to the drawings, wherein like numbers denote like parts throughout the several views, FIG. 1 illustrates an example room (e.g., a hotel) 10 within which is installed a PTAC wireless power system 12 suitable for powering one or more wirelessly powered appliances, e.g., a wirelessly powered PTAC 60. Room 10 includes one or more walls or structural elements (e.g. horizontal, vertical, ceiling, exterior, interior) 11, which may be an outer or periphery wall of a building in some embodiments. The wall 11 may include window(s) 13 as shown in the one embodiment in communication with the exterior of the building or outdoors. However, other walls or building structure are contemplated. For example, PTACs and/or PTAC receptacles may or may not be secured to walls 11, but may otherwise be generally floor standing such that their load is predominantly borne by the floor rather than a wall.

It will also be appreciated that room 10 may be any suitable living or working space within which may be provided including one or more walls or other structure, and within which it may be desired to use a wirelessly powered PTAC 60. Example types of suitable rooms include a kitchen, bar, entertainment area, office area, retail establishment, commercial establishment, residential establishment, hospital, classroom, apartments, etc. In some embodiments, room 10 may even be disposed within a boat or recreational vehicle.

Room 10 may also include one or more electrical outlets 38, e.g., disposed on walls or otherwise wall-mounted. In many rooms, for example, electrical outlets are positioned at various points along a wall 11 to provide users with multiple locations within which to plug in various small, portable and/or electronic devices.

PTAC wireless power system 12, in the illustrated embodiments, is mounted to and supported at least in part by wall 11 although other applications are contemplated. In the embodiment of FIG. 1, for example, PTAC wireless power system 12 includes a PTAC/wall sleeve or receptacle 40 having a wireless power transmitter 44 (occluded by PTAC 60 in FIG. 1). A power cord 48, plugged into an electrical outlet 38, supplies power to PTAC wireless power system 12 or more specifically the receptacle 40, although in other embodiments the PTAC wireless power system may be hard-wired. For example as shown in the one embodiment in FIG. 5, the PTAC sleeve or receptacle 40 may be hard-wired.

Figure 5:
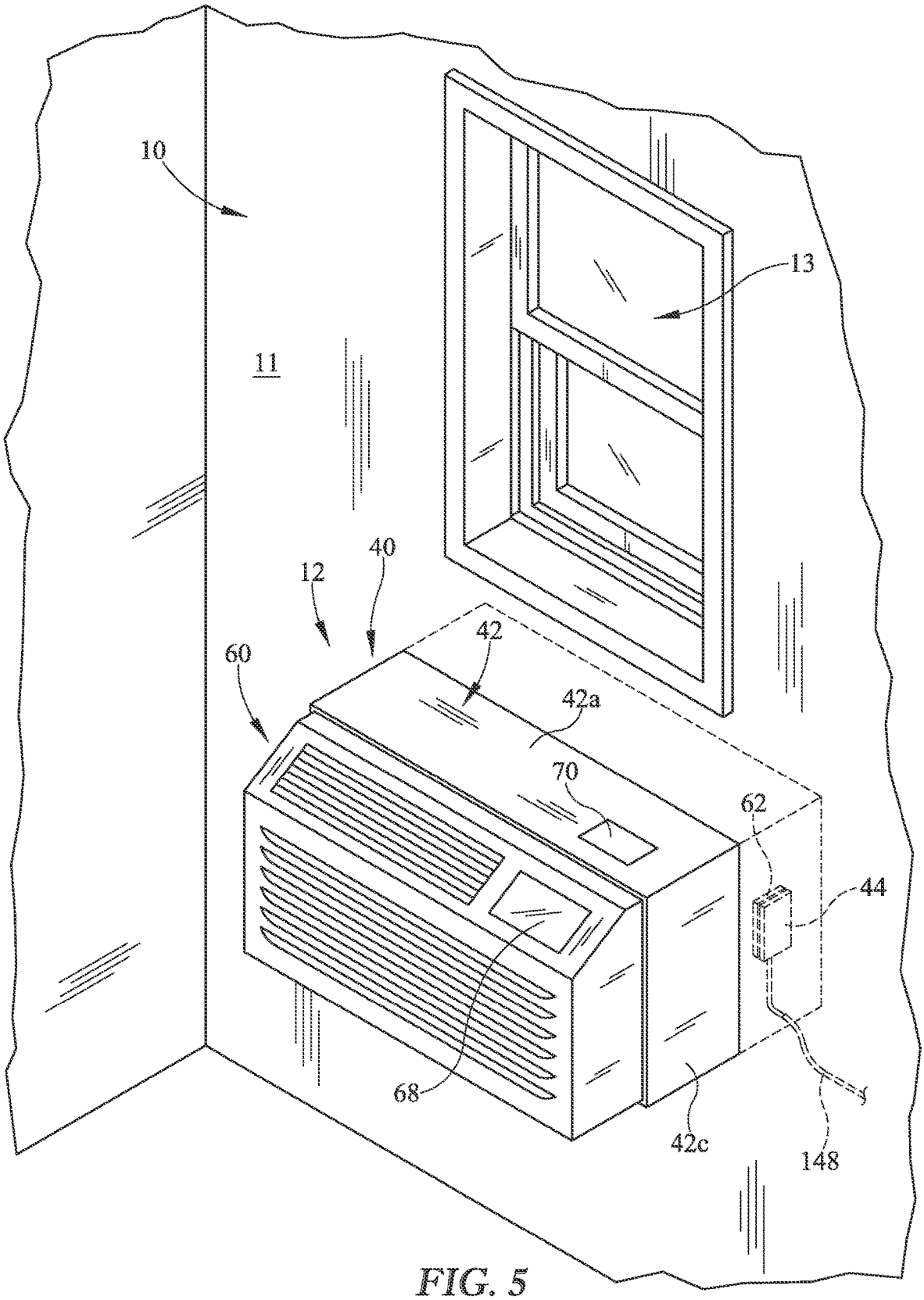
FIG. 5 is a perspective view of another embodiment of PTAC wireless power system, and used for providing wireless power through the side of a wirelessly powered PTAC and using a hard-wired electrical supply.

The wirelessly powered PTAC may be stowed or assembled with the PTAC receptacle in use and separated or deployed away from the PTAC receptacle when replacing/repairing/installing the PTAC 60 and/or when installing the PTAC receptacle 40 within the wall 11. When the PTAC is deployed away from the PTAC receptacle 40 as shown in the one embodiment in FIG. 3 (e.g. deployed position), the wireless power transmitter 44 may be exposed. When it is desirable to stow or install/assemble the PTAC 60 with the PTAC receptacle 40 as shown in FIGS. 1 and 5 (e.g. stowed or in use position), the wirelessly powered PTAC 60 and the wireless power receiver 62 and/or PTAC 60 may be placed with the PTAC receptacle 40 in alignment with wireless power transmitter pad 44, and power may be supplied to the wirelessly powered PTAC. It will be appreciated that PTAC 60 and PTAC receptacle 40 may each be specifically designed such that when PTAC 60 is received within PTAC receptacle 40, wireless power transmitter 44 and wireless power receiver 62 are aligned with one another to maximize power transfer efficiency.

Figure 2:
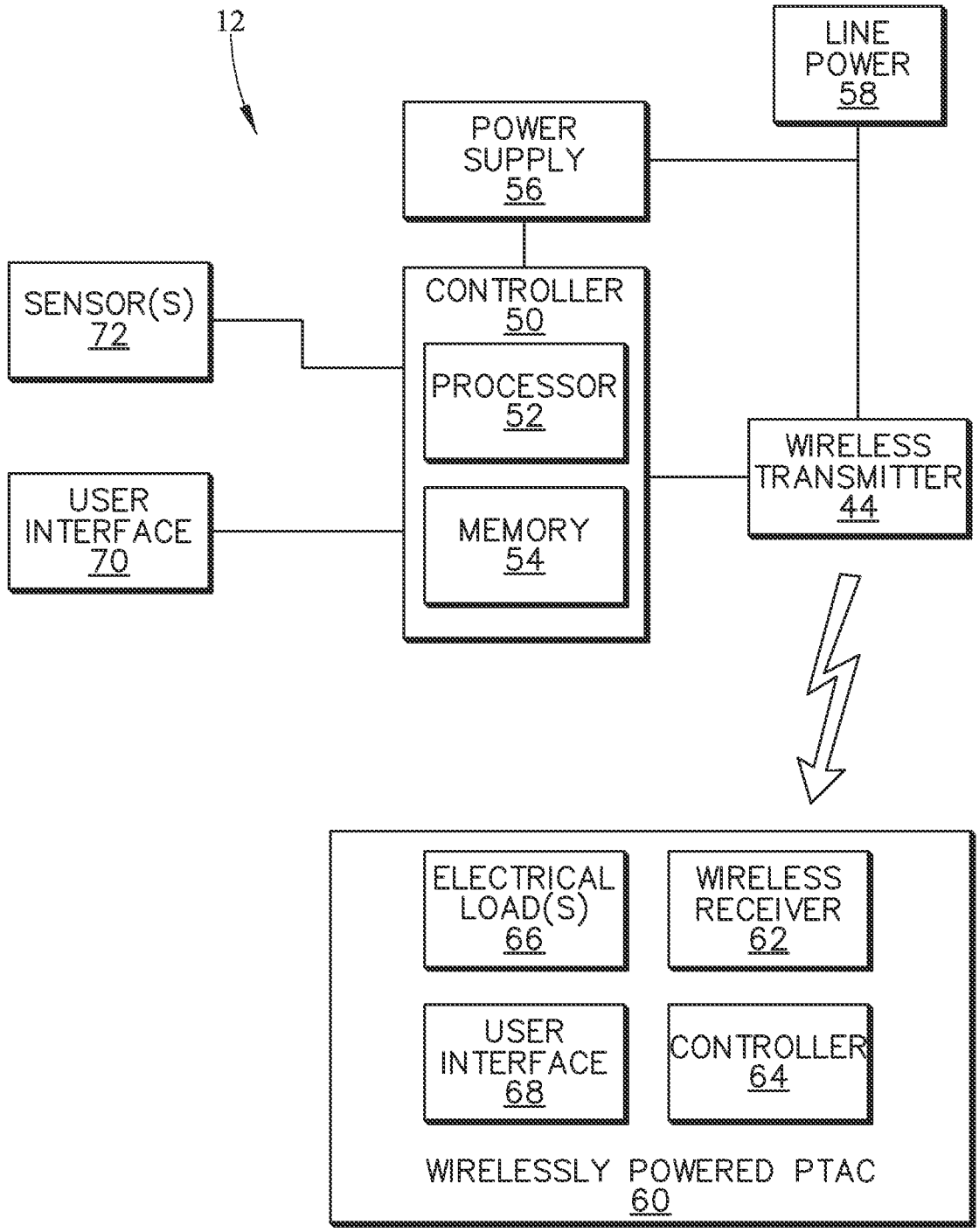
FIG. 2 is a block diagram of an example control system for the PTAC wireless power system of FIG. 1.

Now turning to FIG. 2, PTAC wireless power system 12 may be under the control of a controller 50 that receives inputs from a number of components and drives a number of components in response thereto. Controller 50 may, for example, include one or more processors 52 and a memory 54 within which may be stored program code for execution by the one or more processors. The memory may be embedded in controller 50, but may also be considered to include volatile and/or non-volatile memories, cache memories, flash memories, programmable read-only memories, read-only memories, etc., as well as memory storage physically located elsewhere from controller 50, e.g., in a mass storage device or on a remote computer interfaced with controller 50. Controller 50 may also be implemented at least in part using discrete circuit logic, as will be appreciated by those of ordinary skill having the benefit of the instant disclosure.

As shown in FIG. 2, controller 50 may be powered by a power supply 56, e.g., an AC-DC power supply that is coupled to line power 58 (e.g., 120-240 VAC, as may be provided by a US residential/commercial electrical circuit, 15-30 Amps, 265-277 VAC as may be provided by some US commercial electrical circuits, or other currents/voltages as may be supplied in other countries), via an electrical outlet and plug, or alternatively, a hard-wired connection. Line power 58 also supplies wireless power transmitter 44 with power. Controller 50 may control wireless power transmitter 44 to selectively activate/deactivate the wireless power transmitter, to regulate the power output of the wireless power transmitter, to communicate data to and/or receive data from wirelessly powered PTAC 60, to determine the power output required by the wirelessly powered PTAC, etc. In the illustrated embodiment, wireless power transmitter 44 is compatible with the Ki Kitchen Cordless Standard developed by the Wireless Power Consortium, although other wireless power or charging standards may be used in other embodiments. It will be appreciated that the control over wireless power transmitter 44 by controller 50 to emit a wireless power signal would be well within the abilities of those of ordinary skill having the benefit of the instant disclosure.

A wirelessly powered PTAC 60 may include a wireless power receiver 62 that, when positioned proximate wireless power transmitter 44, receives a wireless power signal to supply power to the wirelessly powered PTAC. Wirelessly powered PTAC 60 may also include a controller 64 to operate wireless power receiver 62, as well as to perform other appliance-related functions. Power received by wireless power receiver 62 may be used to also power one or more electrical loads 66, e.g., one or more motors, compressors, electric heating elements, fans, heat pumps, condensers, evaporators, expansion valves, displays, controls, switches, dampers, slinger wheels, etc., as well as controller 64 itself.

In some embodiments, wirelessly powered PTAC 60 may include a user interface 68 to operate the appliance, and, beyond the supply of wireless power, may operate completely independently from PTAC wireless power system 12. In other embodiments, however, PTAC wireless power system 12 may be functionally integrated with wirelessly powered PTAC 60, e.g., such that a user interface 70 of PTAC wireless power system 12 is used to display information received from wirelessly powered PTAC 60 and/or control one or more functional operations of wirelessly powered PTAC 60 beyond simply controlling the supply of power to the wirelessly powered PTAC, such that a user interface 68 of wirelessly powered PTAC 60 is used to display information received from the PTAC wireless power system 12 and/or control one or more functional operations of PTAC wireless power system 12. In some embodiments, for example, wirelessly powered PTAC 60 may omit any separate user interface, and may be operated through user interface 70 of PTAC wireless power system 12. In some embodiments, for example, PTAC wireless power system 12 may omit the user interface, and may be operated through user interface 68 of wirelessly powered PTAC 60. Communication between PTAC wireless power system 12 and wirelessly powered PTAC 60 may be over a Near Field Communication (NFC) wireless link as supported by the Ki standard, or via a separate wired or wireless network.

It may also be desirable to provide one or more sensors 72 for sensing various states associated with the PTAC wireless power system 12. In some embodiments, for example, a temperature sensor and/or current sensor may be used to monitor wireless power transfer and/or prevent overheating. Other suitable sensors will be appreciated by those of ordinary skill having the benefit of the instant disclosure.

It should be appreciated that wireless power is distinguished from wireless charging in the context of the present disclosure, as while a PTAC wireless power system may in some instances provide power to charge a battery of a PTAC wirelessly coupled to the wireless power system, such a use is secondary to providing wireless power to operate the PTAC, i.e., to provide the primary power supply to the PTAC during its active use. As such, a wirelessly powered PTAC in many instances may lack or not include any battery or other power storage element capable of independently providing sufficient power to operate the wirelessly powered PTAC, such that the wirelessly powered PTAC is effectively inoperable unless coupled to a wireless or wired power source. For many wirelessly powered PTACs, high power draw electrical loads such as electric motors and/or compressors may be used, and to the extent any power storage element is present on such a wirelessly powered PTAC, it is incapable of sufficiently powering such high power draw electrical loads, such that the wirelessly powered PTAC is principally powered through a PTAC wireless power system as described herein.

A PTAC wireless power system consistent with the invention may therefore generally be considered to include at least a sleeve and/or receptacle 40 that is mountable to a wall 11, or portion thereof, along with a wireless power transmitter 44 supported by the receptacle 40 and configured to generate a wireless power signal to power a wirelessly powered appliance 60 (e.g. PTAC) positioned proximate thereto. A receptacle, or portions thereof, in particular, may be considered to be mountable to a wall when the receptacle is sized and configured, and in some instances, includes suitable mounting hardware, for securing (e.g. through, within) the receptacle to the wall. For example, a mounting system may be used in some embodiments to secure/support/couple the PTAC receptacle to the wall. In some embodiments, the mounting system (e.g. bracket, extension, grill) may include one or more portions of the wireless transmitter.

Mounting may occur through the use of fasteners and/or adhesives, and mounting may be made to any structure of a wall and/or structure providing suitable support (e.g. mounting system). Mounting, for example, may be made through the use of threaded fasteners that extend into the surface of a wall in some embodiments. In addition, in some embodiments, additional mounting hardware may be used to mount a receptacle to a wall, e.g., one or more mounting brackets, and in some embodiments a receptacle may be removably attachable to a mounting bracket such that a bracket may first be mounted to a wall and the receptacle thereafter attached to the mounting bracket to complete the installation. The receptacle and/or mounting bracket may also include, in some embodiments, a structure suitable for hiding a portion of a power cord, e.g., when the receptacle is secured to a wall directly adjacent an electrical outlet such that any extra length of power cord can be hidden from view. In some embodiments, the receptacle may be secured directly to a portion of the wall outlet/box.

The PTAC receptacle may be a variety of shapes, sizes, quantities, and constructions and still be within the scope of the invention. In some implementations, the PTAC sleeve/receptacle 40 may include one or more members 42. The one or more members 42 may include the wireless transmitter 44, or portions thereof. The one or more members may position the wireless transmitter 44 to communicate and/or align with the wireless power receiver 62 when the PTAC is stowed. The one or more members 42 may engage/couple/receive/support at least a portion the wirelessly powered PTAC 60. The one or more members may engage a portion of the wall 11 and/or define at least a portion of a through opening 45 within the wall. The one or more members 42 may define at least a portion of an inner periphery 43 defining the though opening 45 therein. As shown in the one embodiment, the one or more members 42 may include a top wall 42*a*, bottom wall 42*b*, and opposing side walls 42*c* interconnecting the top wall and the bottom wall. The through opening 45 of the receptacle 40 may receive the wirelessly powered PTAC 60, or portions thereof, when in the use/stowed configuration. Although the receptacle defines a 360 degree through opening, the one or more members may define a portion of the receptacle less than 360 degrees in some embodiments. The PTAC receptacle 40 and/or member(s) may be of a variety of shapes, sizes, quantities, and/or constructions and still be within the scope of the invention. The PTAC receptacle may be capable of receiving one or more PTACs of a variety of characteristics. For example when replacing or installing, the PTAC receptacle may stow/receive/engage a variety of different/replacement PTACs having different sizes, shapes, electrical loads, user interfaces, controls, constructions, etc. Alternatively when replacing the PTAC, the replacement PTAC may have one or more characteristics the same (e.g. shapes, sizes, electrical loads).

In some implementations, the PTAC receptacle 40, system 12, and/or member(s) 42 may include at least one wireless transmitter 44. As shown in the one embodiment in FIGS. 1, 3, and 4, the bottom wall 42*b* or member 42 may include the wireless transmitter 44. Correspondingly, the bottom, or adjacent thereto, of the wirelessly powered PTAC may include the wireless power receiver 62. As shown when in the stowed position or aligned, the wireless power transmitter may be upwardly-facing to oppose a downwardly-facing wireless power receiver of the wirelessly powered PTAC. As shown in the one embodiment in FIG. 5, the side wall 42*c* or member 42 may include the wireless transmitter 44. Correspondingly, the side, or adjacent wall thereto, of the wirelessly powered PTAC 60 may include the wireless power receiver 62. As shown when in the stowed position or aligned, the wireless power transmitter may be side-facing to oppose a side-facing wireless power receiver of the wirelessly powered PTAC. Other positions of the wireless transmitter 44 and/or wireless power receiver 62 are contemplated. For example, the top wall of the receptacle 40 may include the wireless transmitter 44 and the PTAC top wall may include the wireless power receiver 62. Whereby when in the stowed position or aligned, the wireless power transmitter may be downwardly-facing to oppose an upwardly-facing wireless power receiver of the wirelessly powered PTAC. Further for example, a mounting bracket or accessory for the PTAC receptacle may include the wireless transmitter.

In some implementations, the wireless power transmitter may be inwardly-facing and/or direct a wireless power signal inwardly to supply power to the wirelessly powered PTAC. The wireless power transmitter may face inwardly or radially inward from the inner periphery 43, member 42, and/or receptacle 40 as shown in the embodiments. The wireless power transmitter 44 may face in a direction substantially perpendicular to the telescoping/deploying/stowing direction of the PTAC 60 relative to the PTAC wall receptacle 40 and/or longitudinal axis of the through opening 45. The wireless power transmitter may face longitudinally or parallel to the longitudinal axis of the through opening 45 defined by the one or more members 45 and/or inner periphery 43. Although not shown, wireless power transmitter 44 may face in a direction substantially parallel to the telescoping/deploying/stowing direction of the PTAC 60 relative to the PTAC wall receptacle 40. For example, when in the stowed position or aligned, the wireless power transmitter may be front-facing (e.g. away from the outside/grill, towards front end of PTAC receptacle, towards receiving end or opening of the through opening, towards deploying direction) to oppose a rear-facing (e.g. towards the rear end of the PTAC receptacle, towards grill, towards rear end of PTAC, in stowing direction) wireless power receiver of the wirelessly powered PTAC.

In some implementations, the PTAC wireless power system 12, PTAC receptacle 40, member(s) 42, PTAC 60, and/or wireless transmitter 44 may be powered in a variety of ways or constructions. In the one embodiment shown in FIGS. 1, 3, and 4, the wireless transmitter 44 and/or system 12 is supplied with power by a power cord 48 that is plugged into an electrical outlet 38 housed in a junction box 114 positioned on a wall 11. In the one embodiment shown in FIG. 5 illustrates another variation, whereby rather than being powered by a power cord plugged in to electrical outlet 38, PTAC wireless power system 12 may be hard-wired to an electrical circuit (e.g. junction box), as represented by wire 148 shown running within wall 11.

Figure 3:
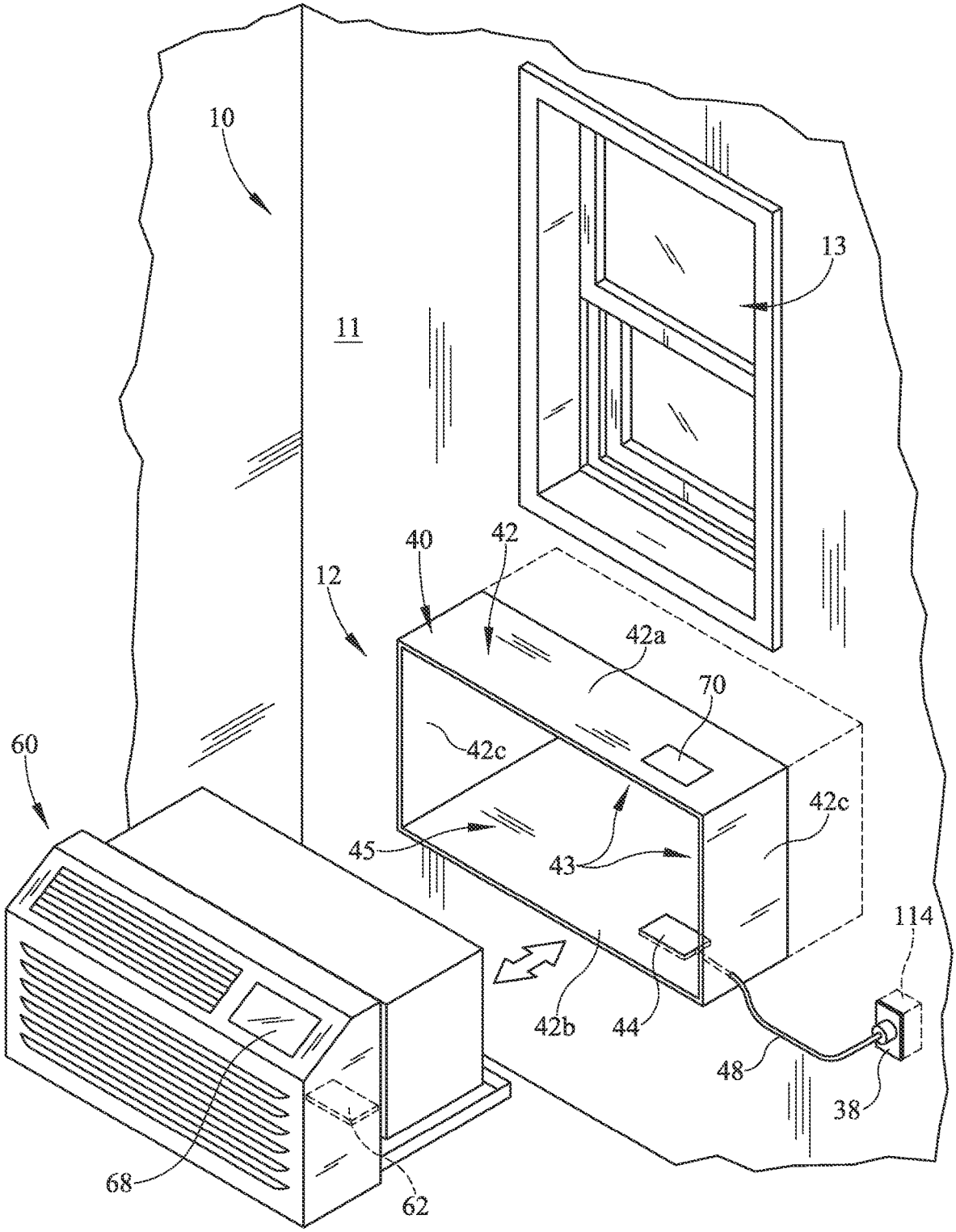
FIG. 3 is a perspective view of a room incorporating a PTAC wireless power system, illustrating the wirelessly powered PTAC in a deployed position relative to the PTAC receptacle.
Figure 4:
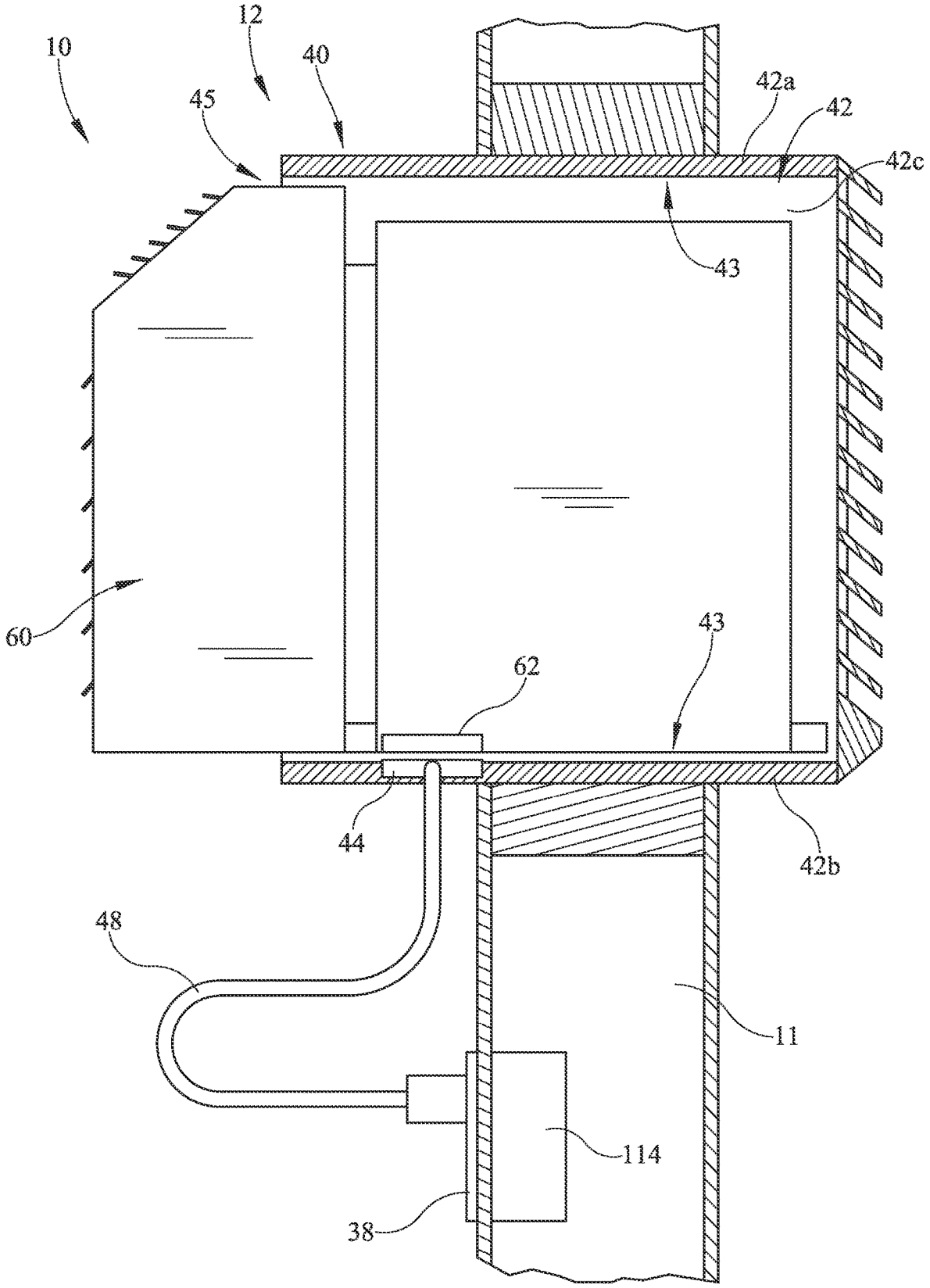
FIG. 4 is a side cross sectional view of the PTAC wireless power system of FIG. 1.

In use, PTAC 60 is stowed with the PTAC wireless power system 12 or PTAC receptacle 40 in the configuration illustrated in FIGS. 1, 4, and 5, with PTAC 60 nested/coupled/stowed (e.g. releasably) with PTAC receptacle 40, or portions thereof. When it is desired to power a wirelessly powered PTAC 60, when in the use or stowed position/configuration (FIGS. 1, 4, and 5) the wirelessly powered PTAC 60 with its wireless power receiver 62 is aligned with wireless power transmitter 44 of the PTAC receptacle 40. Power may then be supplied to the wirelessly powered PTAC 60, e.g., automatically after detection of wireless power receiver 62 by wireless power transmitter 44, or manually after user selection of an "on" function supported by PTAC wireless power system 12 or wirelessly powered PTAC 60. If the wirelessly powered PTAC 60 is desired to be removed from the stowed position to the deployed position as illustrated in FIG. 3, wirelessly powered PTAC 60 may be removed from PTAC receptacle 40 (e.g. misalignment of the receiver and transmitter).

In some implementations, the wireless transmitter and receiver may communicate with each other to negotiate appropriate power transfer. Whereby a PTAC receptacle may be used with different types of PTACs (e.g. having different power requirements), and automatically adjust to supply the appropriate power for the corresponding PTAC installed therein. For example in a hotel application that may have 265/277 VAC power, a PTAC receptacle 40 in the room may be installed with a PTAC 60 for use with 208/230 VAC and have the wireless power system 12 adjust the power supplied to meet the requirements of these (previously-incompatible) PTACs.

It will be appreciated that, while certain features may be discussed herein in connection with certain embodiments and/or in connection with certain figures, unless expressly stated to the contrary, such features generally may be incorporated into any of the embodiments discussed and illustrated herein. Moreover, features that are disclosed as being combined in some embodiments may generally be implemented separately in other embodiments, and features that are disclosed as being implemented separately in some embodiments may be combined in other embodiments, so the fact that a particular feature is discussed in the context of one embodiment but not another should not be construed as an admission that those two embodiments are mutually exclusive of one another. Various additional modifications may be made to the illustrated embodiments consistent with the invention. Therefore, the invention lies in the claims hereinafter appended.

What is claimed is:

1. A PTAC wireless power system comprising:

a PTAC receptacle configured to mount to an outer wall; and a wireless power transmitter supported by the PTAC receptacle and configured to generate a wireless power signal to power a wirelessly powered PTAC positioned proximate thereto.

2. The PTAC wireless power system of claim 1 wherein the wirelessly powered PTAC is movable between a deployed position and a stowed position relative to the PTAC receptacle.

3. The PTAC wireless power system of claim 2 wherein the wireless power transmitter is upwardly-facing to oppose a downwardly-facing wireless power receiver of the wirelessly powered PTAC when the wirelessly powered PTAC is in the stowed position.

4. The PTAC wireless power system of claim 2 wherein the wireless power transmitter is downwardly-facing to oppose an upwardly-facing wireless power receiver of the wirelessly powered PTAC when the wirelessly powered PTAC is in the stowed position.

5. The PTAC wireless power system of claim 2 wherein the wireless power transmitter is side-facing to oppose a side-facing wireless power receiver of the wirelessly powered PTAC when the wirelessly powered PTAC is in the stowed position.

6. The PTAC wireless power system of claim 1 further comprising a power cord configured to supply power to the wireless power transmitter from a wall-mounted electrical outlet.

7. The PTAC wireless power system of claim 1 wherein the PTAC receptacle is configured to supply power to the wireless power transmitter from a hard-wired connection of an electrical circuit.

8. The PTAC wireless power system of claim 1 further comprising a user interface and a controller configured to operate the user interface and the wireless power transmitter, wherein the controller is further configured to control a functional operation of the wirelessly powered PTAC using the user interface.

9. The PTAC wireless power system of claim 1 wherein the wirelessly powered PTAC includes a wireless power receiver, a user interface, and a controller configured to operate the user interface and the wireless power receiver, wherein the controller is further configured to control a functional operation of the PTAC receptacle using the user interface.

10. The PTAC wireless power system of claim 1 wherein the wireless power transmitter is configured to supply power to a wirelessly powered PTAC including an electric motor and/or a compressor and lacking a power storage element sufficient to otherwise power the wirelessly powered PTAC.

11. The PTAC wireless power system of claim 1 wherein the PTAC receptacle includes one or more members defining at least a portion of a through opening, wherein the wireless power transmitter is supported by the one or more members of the PTAC receptacle.

12. The PTAC wireless power system of claim 11 wherein the one or more members includes a top wall, a bottom wall, and opposing side walls interconnecting the top wall and the bottom wall.

13. The PTAC wireless power system of claim 1 further comprising a controller configured to regulate a power output of the wireless power transmitter.

14. The PTAC wireless power system of claim 13 wherein the controller is configured to determine the power output required by the wirelessly powered PTAC and control the wireless power transmitter to output a wireless power signal that meets the power output required by the wirelessly powered PTAC.

15. The PTAC wireless power system of claim 1 wherein the wireless power transmitter is inwardly-facing to oppose an outwardly-facing wireless power receiver of the wirelessly powered PTAC.

16. A PTAC wireless power system comprising:

a wirelessly powered PTAC having a wireless power receiver; and a PTAC receptacle having a wireless power transmitter configured to generate a wireless power signal in communication with the wireless power receiver of the wirelessly powered PTAC to power the wirelessly powered PTAC positioned proximate thereto.

17. The PTAC wireless power system of claim 16 further comprising a user interface and a controller configured to operate the user interface and the wireless power transmitter, wherein the controller is further configured to control a functional operation of the wirelessly powered PTAC using the user interface.

18. The PTAC wireless power system of claim 16 wherein the wirelessly powered PTAC includes a wireless power receiver, a user interface, and a controller configured to operate the user interface and the wireless power receiver, wherein the controller is further configured to control a functional operation of the PTAC receptacle using the user interface.

19. The PTAC wireless power system of claim 16 further comprising a controller configured to regulate a power output of the wireless power transmitter.

20. The PTAC wireless power system of claim 19 wherein the controller is configured to determine the power output required by the wirelessly powered PTAC and control the wireless power transmitter to output a wireless power signal that meets the power output required by the wirelessly powered PTAC.

21. A wirelessly powered PTAC comprising:

a PTAC unit configured to couple with a PTAC receptacle between a stowed position and a deployed position; and a wireless power receiver supported by the wirelessly powered PTAC and configured to receive a wireless power signal provided by a wireless power transmitter of the PTAC receptacle to power the wirelessly powered PTAC when positioned in the stowed position.

* * * * *